US010494873B2

(12) United States Patent
Chiu et al.

(10) Patent No.: US 10,494,873 B2
(45) Date of Patent: Dec. 3, 2019

(54) ROLLER CONE BIT HAVING GLAND FOR FULL SEAL CAPTURE

(71) Applicant: VAREL INTERNATIONAL IND., L.P., Carrollton, TX (US)

(72) Inventors: Chengwei Chiu, Spring, TX (US); Matthew Charles Stroever, Spring, TX (US); Johnathan Walter Howard, Conroe, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 149 days.

(21) Appl. No.: 15/785,786

(22) Filed: Oct. 17, 2017

(65) Prior Publication Data

US 2018/0128053 A1 May 10, 2018

Related U.S. Application Data

(60) Provisional application No. 62/419,511, filed on Nov. 9, 2016.

(51) Int. Cl.
*E21B 10/25* (2006.01)
*E21B 10/22* (2006.01)

(52) U.S. Cl.
CPC ..... *E21B 10/25* (2013.01); *E21B 10/22* (2013.01); *E21B 2010/225* (2013.01)

(58) Field of Classification Search
CPC ..... E21B 10/22; E21B 10/25; E21B 2010/225
See application file for complete search history.

(56) References Cited

U.S. PATENT DOCUMENTS

| | | | | |
|---|---|---|---|---|
| 4,429,854 | A | 2/1984 | Kar | |
| 5,362,073 | A * | 11/1994 | Upton | E21B 10/25 175/371 |
| 6,196,339 | B1 * | 3/2001 | Portwood | E21B 10/25 175/227 |
| 6,279,671 | B1 * | 8/2001 | Panigrahi | E21B 10/25 175/371 |
| 6,769,500 | B2 | 8/2004 | Miglierini | |
| 6,837,317 | B2 | 1/2005 | Byrd | |
| 7,461,708 | B2 | 12/2008 | Yong | |
| 7,721,827 | B2 | 5/2010 | Gallifet | |
| 8,448,723 | B2 | 5/2013 | Crawford | |
| 8,689,907 | B2 | 4/2014 | Lu | |
| 8,783,385 | B2 | 7/2014 | Lu | |

(Continued)

OTHER PUBLICATIONS

Lyons, William C., PhD., P.E. and Plisga, Gary J., B.S.; Standard Handbook of Petroleum & Natural Gas, Second Edition; Bits and Downhole Tools; pp. 4-213 through 4-215; Copyright 2005.

*Primary Examiner* — Caroline N Butcher

(57) ABSTRACT

A bit for downhole use includes: a leg having a mid shirttail and a lower bearing shaft; a roller cone rotatably mounted to the bearing shaft; a row of gage cutters, a row of inner cutters, and a nose cutter, each cutter mounted to or formed on the roller cone; and a gland formed in an inner surface of the roller cone. The gland has: a face; an outer surface; a fillet connected to the outer surface; a corner connecting the face and the outer surface; and an elastomeric o-ring captured in the gland and squeezed between the outer surface and the bearing shaft. A radius of the fillet is greater than one-half of a cross-sectional diameter of the o-ring.

19 Claims, 3 Drawing Sheets

(56) References Cited

U.S. PATENT DOCUMENTS

| | | | | |
|---|---|---|---|---|
| 9,376,866 | B2 | 6/2016 | Nobile | |
| 2010/0018778 | A1* | 1/2010 | Nanayakkara | F16J 15/104<br>175/371 |
| 2012/0160561 | A1* | 6/2012 | Ramirez Santiago | E21B 10/22<br>175/57 |

* cited by examiner

ROLLER CONE BIT HAVING GLAND FOR FULL SEAL CAPTURE

BACKGROUND OF THE DISCLOSURE

Field of the Disclosure

The present disclosure generally relates to a roller cone bit having a gland for full seal capture.

Description of the Related Art

U.S. Pat. No. 4,429,854 discloses a resilient O-ring shaft seal for use in a rotary rock bit wherein the degree of squeeze imposed upon the O-ring seal is increased in one or more discrete steps, occurring as drilling conditions or bearing deterioration cause rising temperatures to be imposed on the seal. The squeeze is increased in discrete steps through a thermally related shape change in one or more nitinol, or the like, back up rings positioned adjacent to the packing ring seal housed within a seal gland. The seal gland is formed between a rock bit journal and a rock cutter cone rotatably mounted to the journal.

U.S. Pat. No. 6,279,671 discloses, in the seal gland in a rotating cone drill bit, the O-ring being initially compressed between the journal and a central portion of the gland which has a cross-section parallel to the journal. These two concentric surfaces provide a minimum amount of contact pressure for a given amount of squeeze than other configurations. Chamfers connect the central portion to the sidewalls of the gland, so that after the seal has worn in use, it will ride up onto the chamfers, where additional squeeze to the seal. This allows the seal to operate in a standard regime during the first part of its lifetime and to automatically shift to a more compressed mode as the seal wears.

U.S. Pat. No. 6,769,500 discloses a rock bit seal in which the shape of the retainer lip (which restrains the seal from axial motion in response to pressure differentials) is optimized, with respect to the as-deformed shape of the seal in place, to achieve a preload stress which is everywhere nonzero. Preferably the ratio of maximum to minimum stress in the as-installed condition is kept to a small ratio, e.g. less than 2:1.

U.S. Pat. No. 7,461,708 discloses a drill bit and seal assembly therefor including a seal gland, an elastomeric sealing seal disposed in the seal gland and having a dynamic sealing surface and a static sealing surface, and at least one auxiliary elastomeric annular seal member disposed between the static sealing surface of the sealing seal and the seal gland. The auxiliary annular seal member serves to prevent relative movement of the sealing seal relative to the surfaces of the seal gland and to permit sealing seals of various cross-sections and shapes to adapt to and function with a conventionally sized and shaped gland. The auxiliary annular seal member is sized and configured and its material properties selected so as to impart the appropriate squeeze to the sealing seal to provide the desired contact pressure and footprint. Choice of the appropriate auxiliary seal member may permit the same sized seal to be employed in seal glands of differing sizes.

U.S. Pat. No. 7,721,827 discloses a drill bit including a bit head and a rotating bit cone. A sealing system for the drill bit includes a seal gland and a seal retained within the seal gland. The seal gland is defined by a radial cone surface, a head sealing surface and an opposed cone sealing surface. At least one of the head sealing surface and opposed cone sealing surface is not cylindrical (i.e., the surface is conical and not parallel to an axis of rotation for the cone). Additionally, the radial cone surface may be conical (i.e., the surface does not extend perpendicular to the axis of rotation of the cone). The seal is radially compressed between the head sealing surface and the opposed cone sealing surface. The use of one or more conical surfaces in the gland is provided to bias the compressed seal into a preferred dynamic sealing zone.

U.S. Pat. No. 8,448,723 discloses a drill bit including a floating journal bushing, a seal, a cutter having a seal gland for the seal and a cutter bearing surface proximate to the journal bearing, wherein the cutter bearing surface has a first inner diameter, and a journal, wherein the cutter is rotatably coupled about the journal, wherein the journal bearing is rotatably coupled about the journal, wherein the journal has a seal boss having a first diameter, and a journal bearing surface having a second diameter, and wherein the first diameter is less than the first inner diameter.

U.S. Pat. No. 8,689,907 discloses surface texturing employed to modify the topography of one or more surfaces (radial or cylindrical) of the sealing system for a roller cone rock bit. The surface texturing produces a regular or repeated patterned dimpled surface which retains additional lubricant helpful in reducing friction in the boundary and mixed lubrication regimes.

U.S. Pat. No. 8,783,385 discloses a drill tool including a bit body, at least one bearing shaft extending from the bit body and a cone mounted for rotation on the bearing shaft. A mechanical seal is disposed between the bearing shaft and the cone in a seal gland. The mechanical seal includes a rigid seal ring having a dynamic sealing surface with the cone and another non-sealing surface exposed to an aperture in the seal gland. The mechanical seal further includes at least one cooling channel formed in the another non-sealing surface of the rigid seal ring, the cooling channel having an open end in fluid communication with the aperture in the seal gland.

U.S. Pat. No. 9,376,866 discloses a hybrid rotary cone drill bit including a plurality of legs. A bearing shaft extends from each leg, and a rotary cone is rotationally coupled to each bearing shaft. At least one rotary cone includes a nose row of cutting structures, an inner row of cutting structures, and a gage row of cutting structures. The nose row and the inner row of cutting structures are formed of milled teeth. The gage row of cutting structures is formed of cutter inserts.

SUMMARY OF THE DISCLOSURE

The present disclosure generally relates to a roller cone bit having a gland for full seal capture. In one embodiment, a bit for downhole use includes: a leg having a mid shirttail and a lower bearing shaft; a roller cone rotatably mounted to the bearing shaft; a row of gage cutters, a row of inner cutters, and a nose cutter, each cutter mounted to or formed on the roller cone; and a gland formed in an inner surface of the roller cone. The gland has: a face; an outer surface; a fillet connected to the outer surface; a corner connecting the face and the outer surface; and an elastomeric o-ring captured in the gland and squeezed between the outer surface and the bearing shaft. A radius of the fillet is greater than one-half of a cross-sectional diameter of the o-ring.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
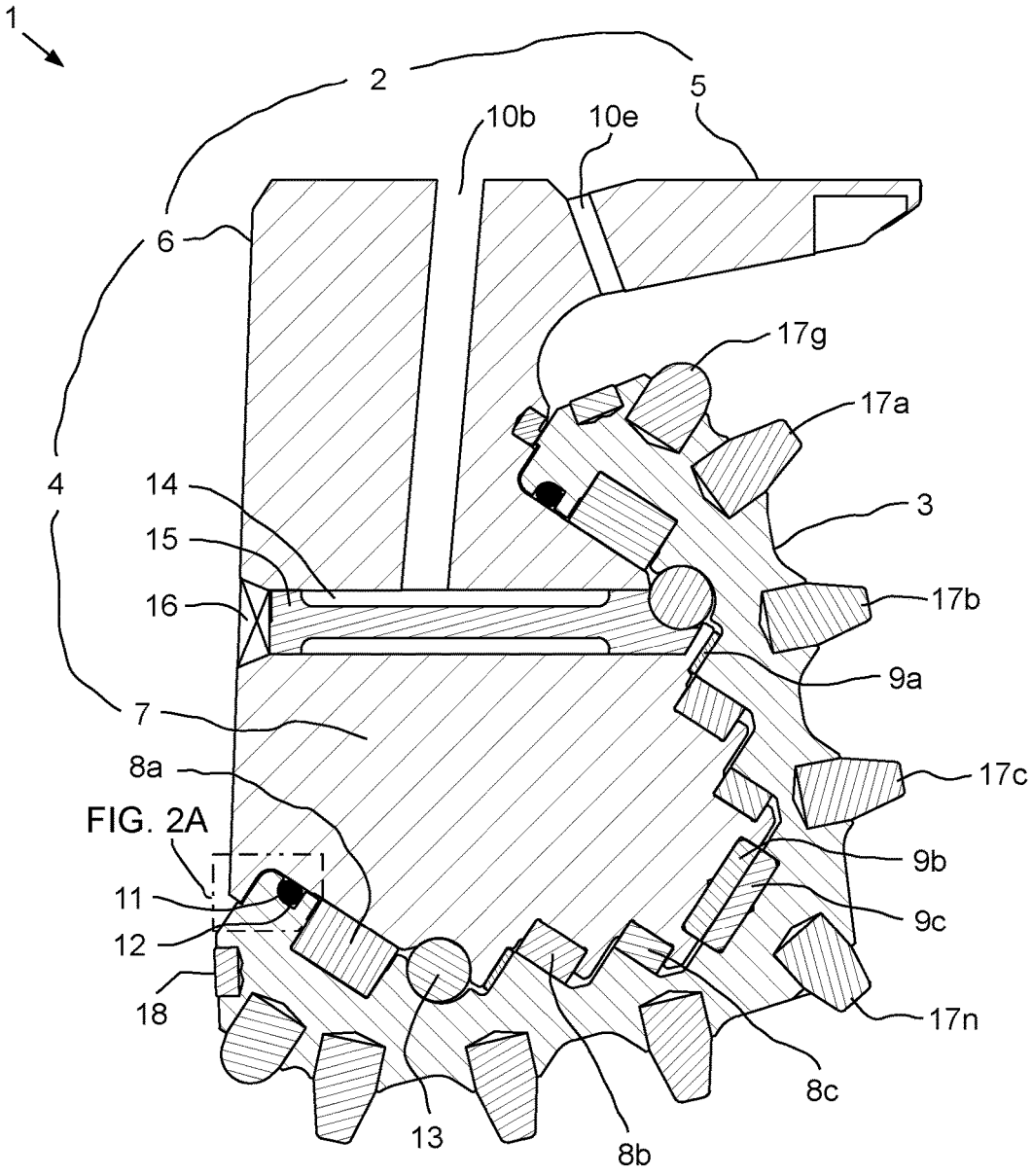
FIG. 1 illustrates a portion of a roller cone drill bit having a gland for full seal capture, according to one embodiment of the present disclosure.

FIG. 1 illustrates a portion of a roller cone drill bit 1 having a gland 12 for full seal capture, according to one embodiment of the present disclosure. The drill bit 1 may include a body 2 and a roller cone 3. Although only one roller cone 3 is shown, the drill bit 1 may further include a plurality, such as three, roller cones and the second and third roller cones may be similar to the illustrated first roller cone 3. The body 2 may have an upper coupling (not shown) and a lower leg 4 for each roller cone 3, and a throat 5 formed between the legs. The body 2 and the roller cones 3 may each be made from a metal or alloy, such as steel. The body 2 may be made by attaching three forgings together, such as by welding. The legs 4 may be equally spaced around the body, such as three at one hundred twenty degrees. The upper coupling may be a threaded pin for connection to another member of a bottomhole assembly of a drill string for drilling a wellbore. A bore (not shown) may be formed through the coupling and extend to a plenum (not shown) formed in the throat 5.

Each leg 4 may have an upper shoulder (not shown), a mid shirttail 6, a lower bearing shaft 7, and a ported boss (not shown). The shoulder, shirttail 6, ported boss, and bearing shaft 7 of each leg may be interconnected, such as by being integrally formed and/or welded together. Each ported boss may be in fluid communication with the plenum via a respective port formed in the throat 5 and may have a nozzle fastened therein for discharging drilling fluid onto the respective roller cone 3.

Each bearing shaft 7 may extend from the respective shirttail 6 in a radially inclined direction. Each bearing shaft 7 and/or the respective cone 3 may have one or more grooves and each groove may form a race for receiving a respective set 8*a-c* of roller bearings. A thrust washer 9*a* may be disposed between each bearing shaft 7 and the respective cone 3 and/or a pair of thrust washers 9*b,c* may be disposed in opposing aligned grooves formed in each bearing shaft 7 and the respective roller cone. The roller bearing sets 8*a-c* and thrust washers 9*a-c* may support rotation of each cone 3 relative to the respective leg 4.

Alternatively, journal bearings may be used instead of the sets 8*a-c* of roller bearings to support each roller cone 3 from the respective bearing shaft.

Each leg 4 may have a lubricant reservoir (not shown) formed therein and a lubricant passage 10*b* (only partially shown) extending from the reservoir to the respective roller bearing sets 8*a-c* and thrust washers 9*a-c*. The lubricant may be retained within each leg 4 by a respective seal, such as an o-ring 11, positioned in the respective gland 12 formed in an inner surface of the respective cone 3. A pressure compensator (not shown) may be disposed in each reservoir for regulating lubricant pressure therein. An equalization passage 10*e* may extend from each reservoir and through the throat 5 for operation of the respective pressure compensator to regulate the lubricant pressure to be slightly greater than bottomhole pressure.

Each roller cone 3 may be mounted to the respective leg 4 by a set 13 of balls received in a race formed by aligned grooves in each roller cone and the respective bearing shaft 7. The balls may be fed to each race by a ball passage 14 formed in each leg 4 and retained therein by a respective keeper 15 disposed in the ball passage and a respective ball plug 16 closing the ball passage. Each ball plug 16 may be attached to the respective leg 4, such as by welding.

Each roller cone 3 may have a plurality of lands formed therein, such as a heel land, a gage land, one or more inner lands, and a nose land. A row of gage cutters 17*g* may be mounted around each cone 3 at the respective gage land. A row of first inner cutters 17*a* may be mounted around each cone 3 at a respective first one of the inner lands. A row of second inner cutters 17*b* may be mounted around each cone 3 at a respective second one of the inner lands. A row of third inner cutters 17*c* may be mounted around each cone 3 at a respective third one of the inner lands. One or more nose cutters 17*n* may be mounted on each cone 3 at the respective nose land. Each cutter 17*a-c,g,n* may be an insert mounted in a respective socket formed in the respective cone 3 by an interference fit. Each cutter 17*a-c,g,n* may be made from a cermet, such as a cemented carbide, and may have a cylindrical portion mounted in the respective cone and a conical, hemi-spherical, or wedge portion protruding from a respective land of the respective cone 3. The rows of inner cutters 17*a-c* and nose cutters 17*n* of the cones 3 may be offset relative to one another to obtain a complete cutting profile.

A row of protectors 18 may be mounted around each cone 3 at a respective heel land. Each protector 18 may be an insert mounted in a respective socket formed in the respective cone 3 by an interference fit. Each protector 18 may be made from a cermet, such as a cemented carbide, and may be cylindrical.

Alternatively, each cone 3 may have one or more rows of inner cutters. Alternatively, each cone 3 may have teeth milled therein and hardfaced by a ceramic or cermet material instead of the cutter inserts 17*a-c,g,n* for any or all of the cutter rows thereof. Alternatively, at least some of the cutters 17*a-c,g,n* may be capped with polycrystalline diamond (PCD). Alternatively, the protectors 18 may be capped with PCD. Alternatively, each leg 4 and/or each cone 3 may be treated to resist erosion. The treatment may include case hardening, such as carburizing, a layer of hardfacing, and/or mounting of inserts thereto.

The drill bit 1 may be used to drill wellbores for crude oil and/or natural gas exploration and/or production or for geothermal power generation. Alternatively, the drill bit 1 may be used to drill blast holes for a mining operation.

Figure 2A:
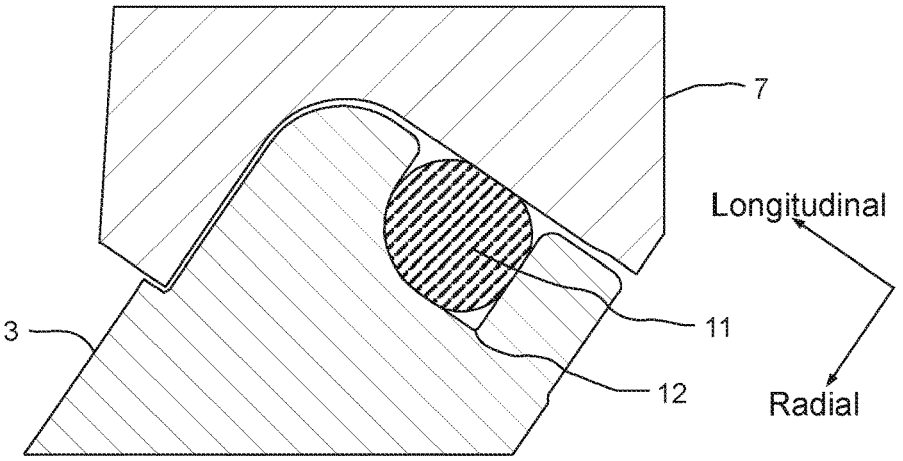
FIG. 2A is an enlargement of a portion of FIG. 1 and illustrates the seal in a squeezed state.
Figure 2B:
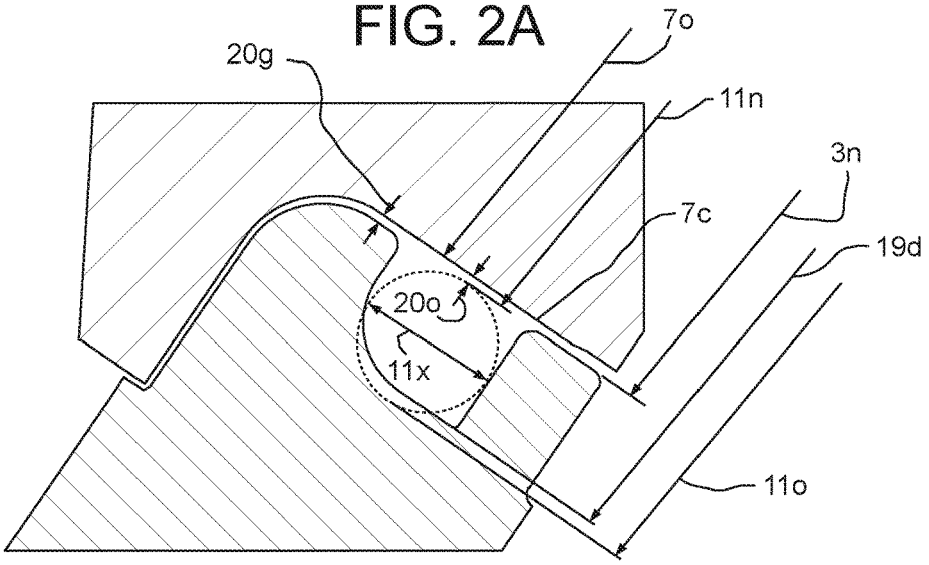
FIG. 2B illustrates the seal in a free state.
Figure 2C:
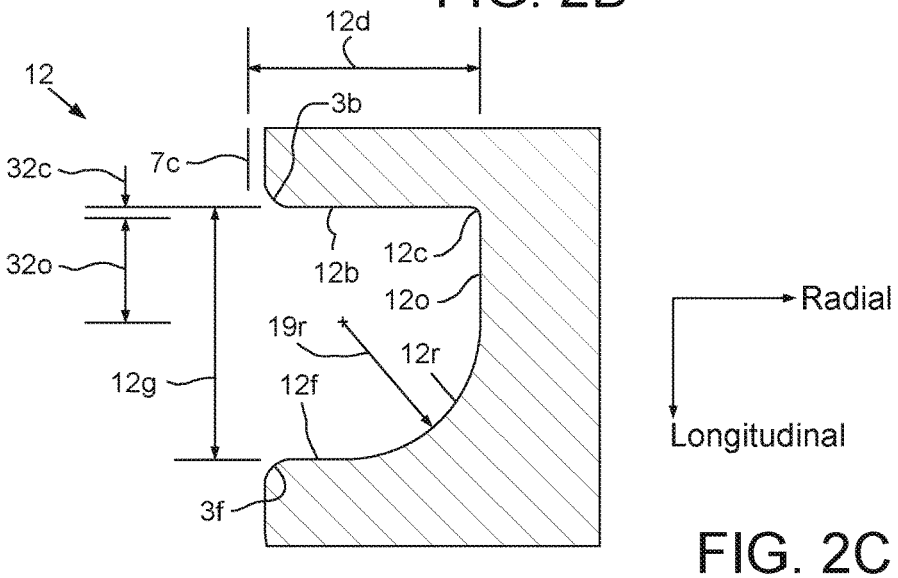
FIG. 2C illustrates the gland.

FIG. 2A is an enlargement of a portion of FIG. 1 and illustrates the seal in a squeezed state. FIG. 2B illustrates the seal in a free state. FIG. 2C illustrates the gland 12. The o-ring 11 may be made from an elastomeric material, such as an elastomer or elastomeric copolymer. The o-ring 11 may have an inner diameter 11*n*, an outer diameter 11*o*, and a cross-sectional diameter 11*x*. The cross-sectional diameter 11*x* of the o-ring 11 may range between one-eighth and one-half inch (three to thirteen millimeters).

The gland 12 may have a front face 12*f*, a back face 12*b*, an outer surface 12*o*, a fillet 12*r*, a corner 12*c*, a length 12*g*, and a depth 12*d*. Each of the front face 12*f* and the back face 12*b* may be flat and the outer surface 12*o* may be cylindrical. The corner 12*c* may connect the back face 12*b* and the outer surface 12*o*. The corner 12*c* may also be a fillet. The fillet 12*r* may connect the outer surface 12*o* and the front face 12*f*. Each of the back face 12*b* and the front face 12*f* may be connected to an inner surface of the cone 3 by a respective round 3*b,f* and the inner surface of the cone adjacent to the gland 12 may have a uniform inner diameter 3*n*. The fillet 12*r* may have a radius 19*r* greater than one-half the cross-sectional diameter 11*x* of the o-ring 11 and less than the cross-sectional diameter of the o-ring. The corner 12*c* may have a radius less than the radius of the fillet 12*r*. The radius of the corner 12*c* may be insignificant relative to the cross-sectional diameter 11*x*, such as less than or equal to one-eighth thereof. The outer surface 12*o* may have a length 32*o* equal to one-half the cross-sectional diameter 11*x* of the o-ring 11. The gland length 12*g* may be equal to the fillet radius 19*r* plus the length 32*o* of the outer surface 12*o* plus a length 32*c* of the corner 12*c*.

Alternatively, the corner 12*c* may be chamfered. Alternatively, the gland 12 may be inverted such that the front and back faces are switched. Alternatively, each of the rounds 3*a,b* may be chamfers instead.

The bearing shaft 7 may have a cylindrical surface 7*c* with a uniform outer diameter 7*o* adjacent the gland 12. To ensure that the cone 3 does not rub on the bearing shaft 7, the inner diameter 3*n* of the cone may be greater than the outer diameter 7*o* of the bearing shaft, thereby defining a gap 20*g* therebetween. The gap 20*g* may range between 0.001-0.005 times the bit diameter. The inner diameter 11*n* of the o-ring 11 may be slightly greater than the outer diameter 7*o* of the bearing shaft 7, such as one to five percent greater, thereby forming a gap 20*o* therebetween. The outer diameter 11*o* of the o-ring 11 may be greater than a diameter 19*d* of the outer surface 12*o* of the seal gland 12, such as one to ten percent greater.

Alternatively, the gap 20*g* adjacent the front face 12*f* may be different than the gap adjacent the back face 12*g*.

The diameter 19*d* of the outer surface 12*o* of the gland 12 may be selected to obtain a radial squeeze of the o-ring 11 ranging between five and twenty percent. The depth 12*d* of the gland 12 may be equal to one-half the difference between the diameter 19*d* of the gland outer surface 12*o* and the outer diameter 7*o* of the bearing shaft 7. The percentage radial squeeze of the o-ring 11 may be defined as (the difference between the cross-sectional diameter 11*x* and the gland depth 12*d*) divided by the gland depth multiplied by one-hundred.

A depth of the back face 12*b* may be equal to the gland depth 12*d* minus the gap 20*g* minus a depth of the corner 12*c* minus a depth of the back round 3*b*. A depth of the front face 12*f* may be equal to the gland depth minus the gap 20*g* minus the fillet radius 19*r* minus a depth of the front round 3*f*. The corner 12*c* may have a forty-five degree angle and a depth ranging between three and twelve percent of the cross-sectional diameter 11*x*. A radius of each round 3*f,b* may be twice the depth of the corner 12*c*.

Alternatively, the front face 12*f* may be omitted and the fillet 12*r* may connect directly to the front round 3*f*.

To assemble the o-ring 11 into the gland 12, the o-ring may be pushed into the gland. The larger outer diameter 11*o* of the o-ring 11 and the restricted depth 12*d* of the gland 12 may cause an inner portion of the o-ring to protrude from the gland (not shown). The cone 3 may then be inserted over the bearing shaft 7. Engagement of the protruding portion of the o-ring 11 with the surface 7*c* may squeeze the o-ring into the gland 12. The o-ring 11 may be squeezed into contact with the gland fillet 12*r*, the outer surface 12*o*, the back face 12*b*, and the shaft surface 7*c*. The squeezed o-ring 11 may be clear of the corner 12*c* and the front face 12*f*. During drilling, the corner 12*c* and/or the front face 12*f* may accommodate deformation of the o-ring 11.

Advantageously, the full capture of the o-ring 11 by the gland 12 prevents or at least limits the longitudinal movement of the o-ring relative thereto. The large radius of the gland fillet 12*r* supports the o-ring 11 during a pressure surge in the lubricant system (pressure in lubricant system greater than bottomhole pressure). The large radius of the gland fillet 12*r* allows for more contact force on the cone 3, thereby preventing seal slip relative to the cone. The gland fillet 12*r* also acts to increase the sealing pressure on the shaft surface 7*c* when the lubricant system experiences the pressure surge. Additionally, the full capture of the o-ring 11 by the gland 12 prevents or at least limits the ability of the o-ring to roll in response to a pressure differential between the lubricant system and the bottomhole pressure.

Additionally, as compared to one or more prior art designs discussed above, the gland 12 requires less squeeze of the o-ring 11 to maintain sealing pressure. The gland 12 also can maintain equivalent sealing pressure using an o-ring 11 having a smaller cross-sectional diameter 11*x*, thereby reducing heat generation.

Alternatively, the radius of the corner 12*c* may be enlarged such that the corner supports the o-ring 11 during a bottomhole pressure surge (bottomhole pressure greater than lubricant pressure). In this alternative, the enlarged radius of the corner 12*c* would still be less than the fillet radius 19*r* and the o-ring 11 would still be clear of the corner in the squeezed state.

Figure 3B:
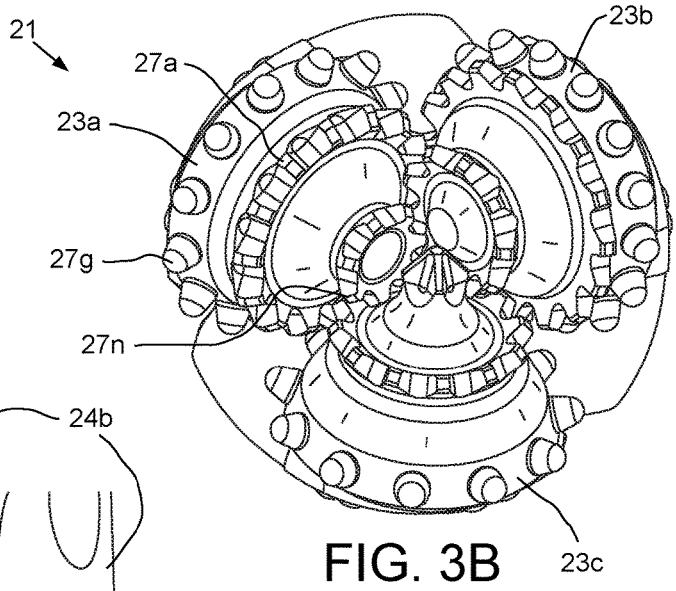
FIGS. 3A and 3B illustrate a roller cone mill bit, according to another embodiment of the present disclosure.
Figure 3A:
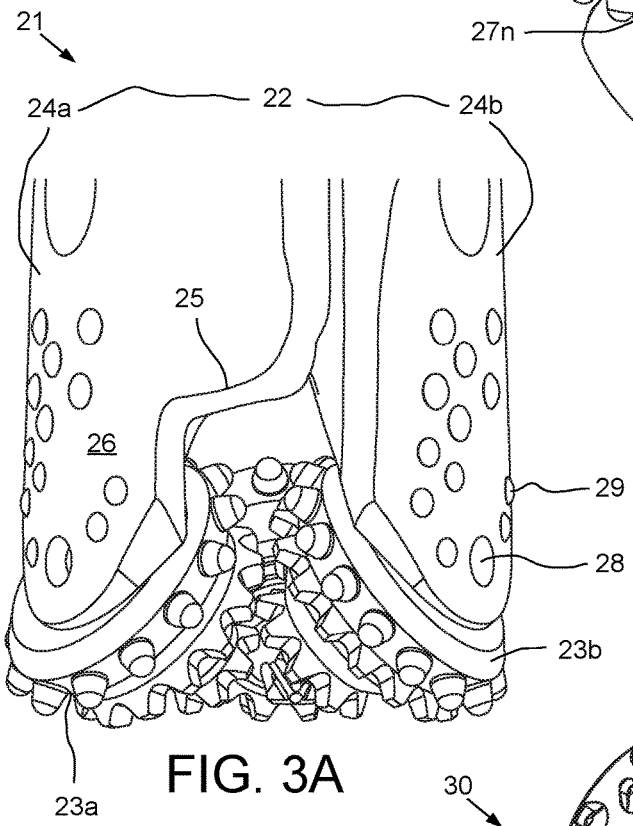

FIGS. 3A and 3B illustrate a roller cone mill bit 21, according to another embodiment of the present disclosure. The mill bit 21 may include a body 22 and one or more, such as two or three, roller cones 23*a-c*. The body 22 may have an upper coupling (not shown) and a lower leg 24*a,b* for each roller cone 23*a-c*, and a throat 25 formed between the legs. The body 22 and the roller cones 23*a-c* may each be made from a metal or alloy, such as steel. The body 22 may be made by attaching three forgings together, such as by welding. The legs 24*a,b* may be equally spaced around the body, such as three at one hundred twenty degrees. The upper coupling may be a threaded pin for connection to another member of a bottomhole assembly of a work string for milling out frac plugs (not shown) set in a wellbore. A bore (not shown) may be formed through the coupling and extend to a plenum (not shown) formed in the throat 25.

Each leg 24*a,b* may have an upper shoulder (not shown), a mid shirttail 26, a lower bearing shaft (not shown), and a ported boss (not shown). The shoulder, shirttail 26, ported boss, and bearing shaft of each leg 24*a,b* may be interconnected, such as by being integrally formed and/or welded together. Each ported boss may be in fluid communication with the plenum via a respective port formed in the throat 25 and may have a nozzle fastened therein for discharging milling fluid onto the respective roller cone 23*a-c*.

Each bearing shaft may extend from the respective shirttail 26 in a radially inclined direction. Each bearing shaft may have one or more journals formed in an outer surface thereof and a respective bearing sleeve (not shown) may be fitted thereon. A thrust washer (not shown) may be disposed between each bearing shaft and the respective cone 23*a-c* and/or a pair of thrust washers (not shown) may be disposed in opposing aligned grooves formed in each bearing shaft and the respective roller cone. The journal bearings and thrust washers may support rotation of each cone 23*a-c* relative to the respective leg 24*a,b*.

Each leg 24*a,b* may have a lubricant reservoir (not shown) formed therein and a lubricant passage (not shown) extending from the reservoir to the respective journal bearings and thrust washers. The lubricant may be retained within each leg 24*a,b* by a respective seal, such as an o-ring (not shown) similar to the o-ring 11, positioned in a respective gland (not shown) similar to the gland 12 formed in an inner surface of the respective cone 23*a-c*. A pressure compensator (not shown) may be disposed in each reservoir for regulating lubricant pressure therein.

Each roller cone 23*a-c* may be mounted to the respective leg 24*a,b* by a set of balls (not shown) received in a race formed by aligned grooves in each roller cone and the respective bearing shaft. The balls may be fed to each race by a ball passage 28 formed in each leg 24*a,b* and retained therein by a respective keeper (not shown) disposed in the ball passage and a respective ball plug (not shown) closing the ball passage. Each ball plug may be attached to the respective leg 24*a,b*, such as by welding.

Each roller cone 23*a-c* may have a plurality of lands formed therein, such as a heel land, a gage land, an inner land, and a nose land. A row of gage cutters 27*g* may be mounted around each cone 23*a-c* at the respective gage land. A row of inner cutters 27*a* may be mounted around each cone 23*a-c* at a respective inner land. One or more nose cutters 27*n* may be mounted on each cone 23*a-c* at the respective nose land. Each gage cutter 27*g* may be an insert mounted in a respective socket formed in the respective cone 3 by an interference fit. Each gage cutter 27*g* may be made from a cermet, such as a cemented carbide, and may have a cylindrical portion mounted in the respective cone and a conical, hemi-spherical, or wedge portion protruding from a respective land of the respective cone 23*a-c*. Each inner cutter 27*a* and nose cutter 27*n* may be a tooth milled in the respective cone 23*a-c* and hardfaced by a ceramic or cermet material.

Each leg 24*a,b* may have protectors 29 mounted along the shirttail 26 to resist erosion. Each protector 29 may be a ceramic or cermet insert interference fit into a respective socket formed along the respective shirttail 26.

Alternatively, a row of protectors may be mounted around each cone 23*a-c* at a respective heel land. Each protector may be an insert mounted in a respective socket formed in the respective cone 23*a-c* by an interference fit. Each protector may be made from a cermet, such as a cemented carbide, and may be cylindrical. Alternatively, the protectors may be capped with PCD.

Alternatively, the gage cutters 27*g* may be capped with PCD.

Figure 3C:
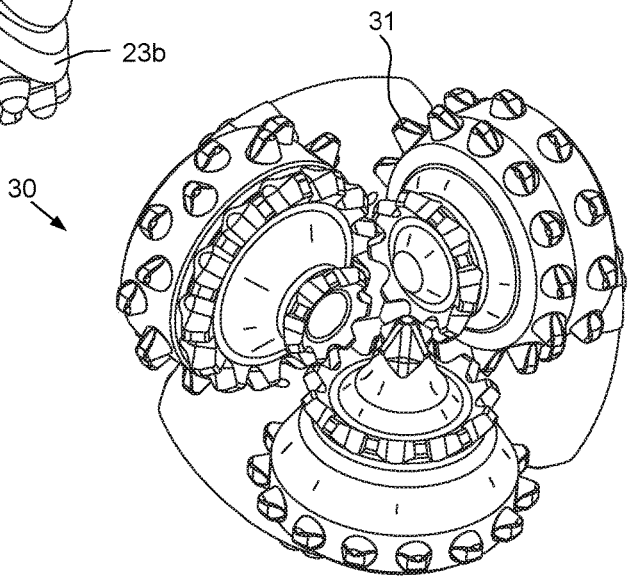
FIG. 3C illustrates an alternative roller cone mill bit, according to another embodiment of the present disclosure.

FIG. 3C illustrates an alternative roller cone mill bit 30, according to another embodiment of the present disclosure. The alternative mill bit 30 may be similar to the roller cone mill bit 21 except that one 31 of the inner rows of cutters includes inserts instead of milled teeth.

While the foregoing is directed to embodiments of the present disclosure, other and further embodiments of the disclosure may be devised without departing from the basic scope thereof, and the scope of the invention is determined by the claims that follow.

The invention claimed is:

1. A bit for downhole use, comprising:

a leg having a mid shirttail and a lower bearing shaft;

a roller cone rotatably mounted to the lower bearing shaft;

a row of gage cutters, a row of inner cutters, and a nose cutter, each cutter mounted to or formed on the roller cone;

a gland formed in an inner surface of the roller cone and having:

a face;

an outer surface;

a fillet connected to the outer surface;

a corner connecting the face and the outer surface; and an elastomeric o-ring captured in the gland and squeezed between the outer surface and the lower bearing shaft, wherein a radius of the fillet is greater than one-half of a cross-sectional diameter of the o-ring.

2. The bit of claim 1, wherein the corner is chamfered.

3. The bit of claim 1, wherein:

the outer surface has a length (32*o*) equal to one-half the cross-sectional diameter (11*x*) of the o-ring, and a length (12*g*) of the gland is equal to the fillet radius (19*r*) plus the length (32*o*) of the outer surface plus a length (32*c*) of the corner.

4. The bit of claim 1, wherein the lower bearing shaft has a cylindrical surface adjacent the gland.

5. The bit of claim 4, wherein:

an inner diameter of the roller cone is greater than the outer diameter of the cylindrical surface, thereby defining a gap therebetween, and the gap ranges between 0.001-0.005 times a diameter of the bit.

6. The bit of claim 4, wherein:

an inner diameter of the o-ring is greater than the outer diameter of the cylindrical surface, and the outer diameter of the o-ring is greater than a diameter of the outer surface of the gland.

7. The bit of claim 6, wherein:

the inner diameter of the o-ring is one to five percent greater than the outer diameter of the cylindrical surface, and the outer diameter of the o-ring is one to ten percent greater than the diameter of the outer surface of the gland.

8. The bit of claim 1, wherein a radial squeeze of the o-ring ranges between five and twenty percent.

9. The bit of claim 1, wherein:

the face is flat, and the outer surface is cylindrical.

10. The bit of claim 1, wherein:

the face is a back face, the gland further has a front face, and the fillet connects the outer surface and the front face.

11. The bit of claim 10, wherein:

the squeezed o-ring contacts the fillet, the outer surface, the back face, and the bearing shaft, and the squeezed o-ring is clear of the corner and the front face.

12. The bit of claim 10, wherein each of the front face and the back face extend radially to the lower bearing shaft.

13. The bit of claim 12, wherein the outer surface is cylindrical.

14. The bit of claim 1, wherein the radius of the fillet is less than the cross-sectional diameter of the o-ring.

15. The bit of claim 1, wherein:

the corner is a second fillet, the corner has a second radius less than the radius of the fillet, and the squeezed o-ring is clear of the corner.

16. The bit of claim 1, wherein each cutter is a cermet insert.

17. The bit of claim 1, wherein:

each gage cutter is a cermet insert, and each inner cutter and the nose cutter is a milled tooth.

18. The bit of claim 1, wherein each gage and inner cutter is a cermet insert.

19. The bit of claim 18, wherein the nose cutter is a milled tooth.

* * * * *